US005303961A

United States Patent [19]

Popil

[11] Patent Number: 5,303,961

[45] Date of Patent: Apr. 19, 1994

[54] SYSTEM FOR ENSURING READY ACCESS TO FIRE HYDRANT WITHOUT SACRIFICING ADJACENT PARKING SPACE FOR MOTOR VEHICLES

[76] Inventor: Nicholas B. Popil, 573 Woodlane Dr., Bay Village, Ohio 44140

[21] Appl. No.: 44,982

[22] Filed: Apr. 8, 1993

Related U.S. Application Data

[63] Continuation-in-part of Ser. No. 779,634, Oct. 21, 1991, abandoned.

[51] Int. Cl.[5] ..... F16L 55/00

[52] U.S. Cl. ..... 285/119; 285/179; 285/901; 256/1; 137/294; 137/377

[58] Field of Search ..... 285/119, 179, 184, 901; 137/272-307, 377, 382; 256/1, 13.1; 166/96; 248/345.1; 405/211

[56] References Cited

U.S. PATENT DOCUMENTS

| | | | |
|---|---|---|---|
| D. 232,090 | 7/1974 | Allenbaugh et al. | D23/234 |
| 33,185 | 9/1861 | Clark | 137/291 |
| 88,589 | 4/1869 | Slocum . | |
| 223,278 | 1/1880 | Connolly | 137/307 |
| 353,581 | 11/1886 | Ogelsby | 137/294 X |
| 554,166 | 2/1896 | Atkinson et al. | 285/901 X |
| 713,951 | 11/1902 | Burkhart | 137/295 X |
| 866,529 | 9/1907 | Smith | 285/901 X |
| 930,770 | 8/1909 | Lancaster | 137/294 |
| 935,857 | 10/1909 | Palmer | 137/294 X |
| 1,641,512 | 9/1927 | VanHecke . | |
| 2,585,694 | 2/1952 | Sisson | 137/13 |
| 2,759,766 | 8/1956 | Thomas | 285/179 X |
| 3,070,115 | 12/1962 | Jester | 137/296 |
| 4,103,504 | 8/1978 | Ehrlich | 405/211 |
| 4,155,672 | 5/1979 | Franks | 405/211 |
| 4,389,890 | 6/1983 | Bolick et al. | 73/431 |
| 4,420,013 | 12/1983 | DiBlasio | 137/382 |
| 4,556,080 | 12/1985 | Picaud | 137/377 X |
| 4,736,765 | 4/1988 | Campbell | 137/296 |
| 4,827,969 | 5/1989 | Lyasko | 137/377 X |
| 4,976,468 | 12/1990 | Shpigel | 285/184 X |

FOREIGN PATENT DOCUMENTS

| | | | |
|---|---|---|---|
| 3656 | 9/1876 | United Kingdom | 137/280 |

*Primary Examiner*—Dave W. Arola
*Attorney, Agent, or Firm*—David A. Burge

[57] ABSTRACT

Proper access for enabling fire hoses to be readily coupled to the hose connections of a fire hydrant is provided without needlessly sacrificing valuable adjacent parking space for motor vehicles by utilizing upwardly oriented fire hydrant hose connections and/or by utilizing open-walled, cage-like protective enclosure components to maintain good and sufficient hydrant clearance and hose connection access space in regions that extend about the hydrant's hose connections. In one preferred form, rounded elbow pipe segments are threaded onto the hose connections of an existing fire hydrant and are rigidly secured in place thereon to provide upwardly oriented fire hydrant hose connections, and/or protective enclosure components are attached to the existing fire hydrant to provide an open-walled cage-like structure that maintains proper obstruction-free access space in regions that extend about the hydrant's hose connections so that fire hoses easily can be coupled to the hydrant. Alternatively, a newly manufactured fire hydrant is provided with upwardly oriented hose connections and/or is provided with protective enclosure components that cooperate, once they are put in place during installation of the hydrant, to ensure that proper obstruction-free access areas are maintained about the hydrant's hose connections so that fire hoses easily can be coupled to the hydrant.

17 Claims, 6 Drawing Sheets

SYSTEM FOR ENSURING READY ACCESS TO FIRE HYDRANT WITHOUT SACRIFICING ADJACENT PARKING SPACE FOR MOTOR VEHICLES

CROSS-REFERENCE TO RELATED APPLICATIONS

The present application is a continuation-in-part of co-pending application Ser. No. 07/779,634 filed Oct. 21, 1991, now abandoned and entitled FIRE HYDRANT ATTACHMENT, referred to hereinafter as the "Parent Case." The disclosure of the Parent Case is incorporated herein by reference, and the benefit of the filing date of the Parent Case is claimed with respect to its disclosed subject matter.

BACKGROUND OF THE INVENTION

1. Field of the Invention

The present invention relates generally to fire hydrants and to attachments therefor, the use of which is intended to ensure that appropriate access to hydrant hose connections is maintained without sacrificing valuable adjacent parking space. More particularly, the present invention relates to the provision and use of structure for defining upwardly oriented hydrant hose connections, and/or to the provision and use of hydrant-connected, open-walled, cage-like structures for maintaining proper obstruction-free access space in regions that extend about the hydrant's hose connections so that fire hoses easily can be coupled thereto.

2. The Referenced Parent Case

Because the invention features that form the subject matter of the co-pending Parent Case provide the core of the subject matter that is disclosed and claimed in this continuation-in-part document, it is appropriate to attribute the benefit of the filing date of the Parent Case to such subject matter.

The terms "hydrant" and "fire hydrant" as utilized in the Parent Case and in the present document are not intended to be interpreted as restricting or limiting the use that is made of invention features to a particular form of fire hydrant. Rather, as those who are skilled in the art readily will understand, invention features that are disclosed in the Parent Case and herein can be utilized with a wide variety of forms of hydrants. Thus, the terms "hydrant" and "fire hydrant" should be interpreted broadly to include such water supply system components as define suitable structure unto which one or more fire hoses can be attached, typically by means of selectively releasable connections, for purposes of communicating the connected fire hoses with mains of waterworks, with standpipes such as frequently are installed in buildings, and the like that are employed to supply pressurized water to or from hoses for use in combating and extinguishing fires.

While familiar forms of fire hydrants of the type that typically are found at curbside locations along city streets (referred to hereinafter as "curbside" style hydrants) are duly depicted in the drawings of both the Parent Case and the present document in disclosing the "preferred form" and the "best mode presently known to the inventor" for carrying out invention practice, it will be understood that such invention features as are disclosed in the Parent Case and in this document are not limited in their applicability to any particular type, style, configuration or construction of hydrant. Thus, while hydrants having some component parts that are connected by means of threaded fasteners are described and illustrated, it will be understood that other suitable forms of fasteners can be substituted; and, likewise, while hydrants are described and illustrated that have threaded hose connections, other forms of hose connections can be substituted without departing from the scope and spirit of such invention features as are disclosed in the referenced Parent Case and in the present document.

3. Prior Art

There are three topics that need to be dealt with, at least briefly, to properly explain the nature of the problem that is addressed with elegance and simplicity by the system of the present invention. One topic has to do with how a conventional fire hydrant typically is constructed and used, for example the familiar curbside style of fire hydrant. A second topic has to do with reasons why "no parking zones" of considerable size have, through custom, come to be associated with locations where conventional fire hydrants are installed. The third topic has to do with the seriously detrimental effects that unquestionably have resulted from the increasingly severe shortage of much needed parking spaces in downtown areas of cities—and how these detrimental effects can be significantly alleviated by effectively addressing, in a novel and improved way, the first and second of these three seemingly unrelated topics.

A typical curbside style hydrant includes an upstanding, generally cylindrical body structure that has a number of features (some being principally ornamental while others are principally functional) that are arranged substantially symmetrically about a substantially vertical center axis of the body. The body usually is formed as a heavy, rigid, impact-resistant casting of metal that has a relatively large diameter passage formed substantially centrally therethrough extending between lower and upper end regions of the body. Hollow formations that project from the sidewall of the cast body of the hydrant usually are formed as integrally cast component portions of the one-piece cast body, and are configured to define hollow hose connections that communicate with the hollow interior of the body.

The hose connections of a typical curbside hydrant normally project from the body in an array of directions that radiate from the substantially vertical center axis of the hollow upstanding body of the hydrant. Ordinarily the hose connections of a hydrant are threaded, with the character of the threads being selected to meet such standards as facilitate the establishment of direct, threaded connections with threaded connectors that are provided at one or both of the ends of fire hoses, preferably without the need to make use of adapters, fittings or other supplemental hardware to quickly establish secure, leak resistant hydrant-to-hose connections.

Near the lower and upper end regions of the body, annular mounting flanges are provided for matingly engaging correspondingly configured mounting flanges of components that connect to the lower and upper end regions of the body. When a pair of mating mounting flanges are ready to be connected, bolts are installed through aligned holes formed through the mating flanges, and nuts are tightened in place on the bolts to form secure, leak-free connections between the mating flanges. At the lower end region of the upstanding body, a bolted connection between mating flanges typically is used to connect the hollow body to a hydrant supply pipe that depends from its point of connection with the hydrant body to an underground location (typically directly beneath the hydrant) where a valve is provided for selectively communicating the supply pipe with an adjacent water main.

Similarly, at the upper end region of the body, a bolted connection between mating flanges typically is used to connect the hollow body to a matingly-flanged crown-shaped cap. An opening typically is formed centrally through the crown-shaped cap, through which the upper end region of an elongate "valve stem" or "operating rod" extends. A suitable seal is interposed between the crown-shaped cap and the upper end region of the valve stem to prevent leakage therebetween while, at the same time, permitting the valve stem to be rotated relative to the crown-shaped cap. A tool-receiving formation is provided to enable the valve stem to be rotated relative to the crown-shaped cap. One type of tool-receiving formation that is widely used is a five-sided head formation that is designed to be engaged by a specially configured wrench.

The valve stem or operating rod depends from within the interior of the crown-shaped cap, extends along the central axis of the body of the hydrant, and depends into the hydrant's supply pipe where it operably connects with the valve that selectively communicates the supply pipe with an adjacent water main. When the valve stem is rotated about the central axis of the body in one direction of rotation, the valve opens to communicate the hydrant's supply pipe with the adjacent water main. When the valve stem is rotated in the opposite direction, the valve closes to terminate such communication.

When a fire hydrant of the aforedescribed curbside style is standing dormant, ready for use, the underground valve normally is closed, the hollow interior of the body of the hydrant normally is not filled with pressurized water, and the hollow hose connections normally are closed by removable caps. The caps are threaded onto the threaded hose connectors of the hydrant for keeping insects, rainwater, debris and other undesirable objects and substances from entering the hollow interior of the body of the hydrant when the hydrant is standing dormant. To aid in preventing unauthorized removal of the caps, each cap usually is provided with a five-sided tool-receiving head formation that can be grasped and rotated by the same specially configured wrench that is carried by authorized personnel for engaging and operating the five-sided tool-receiving head formation that normally is provided atop the hydrant's crown-shaped cap for rotating the valve stem of the hydrant. To prevent the hose connection caps of a hydrant from being lost or otherwise misplaced, it is customary to provide chains or the like to securely connect the caps to other components of the associated hydrant.

In use, hydrant hose connections to which fire hoses are to be coupled are uncapped. To ensure that the hydrant is working and does not contain debris or other unwanted material, pressurized water often is admitted briefly to the hydrant to "flush" the hydrant and check its operation before hoses are attached. After such a check is made, the supply of water is turned off so that fire hoses can be properly connected to the hydrant's hose connections. When the hoses have been extended along appropriate paths for use and are suitably connected to pumper trucks, to other lengths of hose, or to discharge nozzles, a steady flow of pressurized water to the hydrant is initiated by fully opening the hydrant's supply valve. As pressurized water flows into and through the hoses, some hose expansion and increase in hose rigidity will be noted.

Having dealt with the first of the three topics mentioned above, namely the typical construction and manner of use of a conventional fire hydrant, the second topic will be discussed briefly, namely the reasons why "no parking zones" of considerable size customarily have come to be associated with locations where conventional fire hydrants are installed.

Because conventional hydrant hose connections are oriented to project substantially horizontally rather than to project upwardly, it has become somewhat customary to view a fire hydrant as "requiring" a relatively large amount of open, obstruction-free space extending horizontally about the hydrant in order to accommodate horizontally extending reaches of hose, and in order to provide working space for the use by fire department personnel. While there is verity in the viewpoint that a limited amount of protected access space extending about a hydrant is needed in order to effect proper hydrant-to-hose connections, the view that quite a large space "must" be kept entirely open and obstruction free in order for a fire hydrant to be used to its full potential is without sound basis.

An understandably natural extension of the flawed viewpoint that a quite large open space "must" be maintained obstruction free to permit a fire hydrant to be used to its full potential is the equally flawed notion that the only approach that can be taken to ensure needed access to a hydrant is to provide a sizable "no parking zone" adjacent it. While a reasonable degree of access to the vicinity of a fire hydrant unquestionably must be provided, a fire is not fought by stationing a multitude of firefighters within the immediate vicinity of a fire plug. In fact, once hoses have been connected and the hydrant's supply valve has been fully opened, it seldom serves any useful purpose whatsoever for anyone to remain in attendance adjacent a fire hydrant.

Having discussed how fire hydrants are constructed and used, and having discussed why sizable "no parking zones" have come to be associated with locations where fire hydrants are installed, the reader's attention is directed to the third of the three topics mentioned above, namely the severe inadequacy of available vehicle parking space that is confronting many cities, the seriously detrimental effects that are resulting therefrom, and the significant benefits that clearly can obtain if the "no parking zones" that are located adjacent installations of fire hydrants could safely be eliminated—an objective that is addressed by the present invention.

While bringing into service a single pair of parking spaces adjacent a single fire plug may not represent much of a contribution in an effort to deal with the enormous shortage of available parking spaces that is faced daily in downtown areas of large cities, when a pair of restored parking spaces per fire hydrant is multiplied by the tens of thousands of fire hydrant installations that populate the downtown areas of large cities, the cumulative result is a very dramatic increase in the total number of available downtown parking spaces. If vehicles could be parked in the areas that traditionally have been designated as "no parking zones" adjacent fire hydrants, and if this could be done while maintaining such reasonable access as is needed to ensure that fire hydrants can be used safely, reliably, and to their full potential, the significant number of available parking spaces within the downtown area of a city could be increased by as much as ten to twenty percent.

Presently, however, due to acute parking space shortages, commuters often must wait long periods of time and/or conduct time-consuming, fuel-consuming searches to locate needed parking spaces. In downtown areas, parking garages often fill to capacity early during weekdays and/or charge such stiff parking fees (to provide a reasonable return on the rental on property that typically costs in excess of $30,000 per parking space to build) that many commuters simply must make use of parking lots and on-street parking spaces that are located lengthy, inconvenient distances from the commuters' final destinations. Fuel spent by commuters in searching for hard-to-find parking spaces is fuel that, in the public interest, should not be wasted and should not be burned for it adds significantly to air pollution. Time spent by commuters in searching for hard-to-find parking spaces, and in walking long distances to and from parking spaces that are unduly remote is time that, in the public interest, could be put to far more productive use. Dangers encountered by commuters who have no choice other than to walk lengthy distances to and from unduly remote parking spaces are dangers that are in the public interest to eliminate.

While the reasons enumerated above clearly justify the taking of all reasonable steps to address the genuine and increasing need for readily accessible downtown parking space, still another justification resides in the significant increase in revenue for a city that can result from adding between about ten to twenty percent to the city's annual revenue received from parking meters and from rental of parking space in municipal lots and parking garages. At a time when cities are so very much in need of income, and when it clearly is no longer necessary to preserve sizable "no parking zones" adjacent fire hydrants when such space can safely be used both to produce significant revenue and to enhance the availability of premium downtown parking spaces for vehicles, the time is at hand for cities to utilize their "no parking zones" to significant advantage as revenue producing property.

In addition to adding directly, immediately and significantly to the revenues that cities receive on a daily basis from rental of vehicle parking spaces, still another revenue enhancing advantage that obtains from increasing the availability of premium downtown vehicle parking space by between about ten to about twenty percent is the significant increase business that is experienced by downtown merchants if easy-to-find, nearby, on-street parking is made available for use by potential customers. Stated in another way, adding an additional ten to twenty percent to the availability of premium downtown parking space has a positive economic impact that extends well beyond the significant resulting increases in income from parking space rentals.

Thus, while the problem of providing needed vehicle parking space has confronted the public for many years; while the problem and its detrimental effects are becoming increasingly more serious; and while reasonable steps to address these issues would have been taken long ago if an appropriate solution were known, no prior proposal has provided an appropriately simple, inexpensive and easy-to-implement solution. Nor have prior proposals taken the novel approach of addressing "parking problems" by utilizing fire hydrant improvements that are designed to ensure that ready hydrant access is maintained without an attendant need to sacrifice of adjacent vehicular parking space.

SUMMARY OF THE INVENTION

The present invention addresses the foregoing and other problems, needs, and shortfalls of prior proposals by providing a novel and improved system for substantially eliminating the need for "no parking zones" adjacent fire hydrants in order to ensure and preserve good and sufficient hydrant clearance and appropriate access to permit hoses to be coupled to the hose connections of a fire hydrant. Stated in another way, features of the present invention permit vehicles to be parked in relatively close proximity to fire hydrants while maintaining good and sufficient hydrant clearance and proper hose connection access, whereby the number of premium parking spaces that are available in the downtown area of a city can be quickly, easily and dramatically increased at a minimum of cost that rapidly will be repaid by a perpetual new source of rental income.

One advantage of the present invention is that features of the present invention can be utilized with existing fire hydrants, essentially as attachments thereto, and without having to replace or discard components of existing hydrants. This advantage extends to existing hydrants regardless of whether they already are installed and in service, or whether they have yet to be installed and are being readied for installation.

In accordance with one form of the preferred practice of the present invention, proper access for permitting fire hoses to be readily coupled to the hose connections of a fire hydrant is provided without needlessly sacrificing valuable adjacent parking space for motor vehicles by reoriented fire hydrant hose connections to minimize the concern that needed access space extending about the hose connections will be intruded upon. Preferably, rounded elbow pipe segments are threaded onto the hose connections of an existing fire hydrant and are rigidly secured in place thereon to provide hydrant hose connections that are reoriented, preferably upwardly, so that only a minimum of hydrant clearance needs to be maintained, and so that few if any additional measures need to be taken to ensure that adequate hose connection access space is maintained.

Upwardly oriented hose connections provided on a conventional curbside style fire hydrant are more easily accessed than are the normally horizontally extending hose connections both because they extend to a more accessible height above the ground, and because their upwardly facing direction of orientation renders them easy to view. The convenient height and viewability of upwardly facing hose connections makes it easier to more quickly access and remove hose connection caps therefrom, and to couple fire hoses thereto. Fire hoses that are coupled to upwardly oriented hydrant hose connections can be gently curved to duct flows of pressurized water in substantially any desired direction(s) away from the location of the hydrant. If need be, an upwardly directed hydrant-connected hose can be extended in a curved path to overlie portions of a vehicle that is parked adjacent the hydrant to which the hose is connected.

Alternatively, or in combination with the use of reoriented hose connections, another form of preferred practice of the present invention utilizes protective enclosure components that are attached to an existing fire hydrant to provide an open-walled, cage-like, protective enclosure that extends about the hose connections of a hydrant to maintain good and sufficient hydrant clearance, and to ensure that proper hose connection access space is kept free of obstruction. Suitably configured enclosure components can be used to provide a suitably configured open-walled, cage-like protective enclosure that extends, as may be needed, about selected portions of an existing hydrant even if the hydrant's conventional horizontally extending hose connections are not reoriented to extend upwardly. If a motor vehicle is moved too closely into proximity with a cage-protected hydrant, the relatively loud scraping noise that will result quickly will alert the driver to pull away so that no damage is done to the fire hydrant, and so that hydrant access space is not infringed upon.

As an alternative to working with existing fire hydrants to effect one or both of the types of improvements that are described above, the preferred practice of the present invention can be embodied in a newly manufactured fire hydrant by providing it with optimally oriented (preferably upwardly facing) fire hydrant hose connections, and/or by providing it with protective enclosure components that cooperate, once they are put in place during installation of the hydrant, to ensure that good and sufficient hydrant clearance is maintained, and that adequate obstruction-free access space extending about the hydrant's hose connections also is maintained so that fire hoses easily can be coupled to the hydrant. The optimally oriented hose connections of the hydrant can be cast as integral portions of the upstanding hollow body of the hydrant. Alternatively, curved elbows can be installed at the factory or elsewhere, as needed, to provide optimally oriented (preferably upwardly facing) hose connections. Likewise, protective enclosure components can be formed integrally with other component parts of a newly manufactured hydrant, can be factory-installed, in whole or in part, during the manufacturing process, and/or can be site-installed, in whole or in part, when a new hydrant is being put into service.

A significant advantage that is offered by features of the present invention is that selected features of the invention can be used alone or in combination as may be needed to maintain proper access to and usability of fire hydrants in installations where the character of the need to provide optimally oriented hose connections and/or the character of the need to protectively enclose selected portions of particular fire hydrants may vary from one hydrant to another. Stated in another way, a strength of the present invention resides in the versatile selection of features that it provides—features that are well suited for use in various forms of combination to achieve the objective of minimizing, if not eliminating, the need for "no parking zones" adjacent fire hydrants that are installed in a variety of environments.

Utilizing the approach of providing upwardly facing hydrant hose connectors is of particular value when the positioning of a hydrant is such that, due to the level at which its hose connectors otherwise would be positioned, there is a danger that adequate access to and/or proper use of the hose connectors might be obstructed by one or more motor vehicles being parked adjacent to the hydrant. Utilizing the approach of providing open-walled, cage-like protective enclosure components to maintain suitable hydrant clearance and obstruction free access space in regions that extend about the hydrant's hose connections is of particular value when used to assist in protectively shrouding upwardly oriented hose connectors, and/or when used with conventional horizontally oriented hydrant hose connections that need to be protectively shrouded to alert drivers of vehicles or the like if they inadvertently encroach upon access space that needs to be preserved for use in coupling hoses to a fire hydrant.

In the most preferred practice of the present invention, the use of protective enclosure components is combined with the use of upwardly turned hose connections to make quite certain that good and sufficient hydrant clearance is maintained while minimizing the need for "beside-the-hydrant" hose connection access space.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Figure 4:
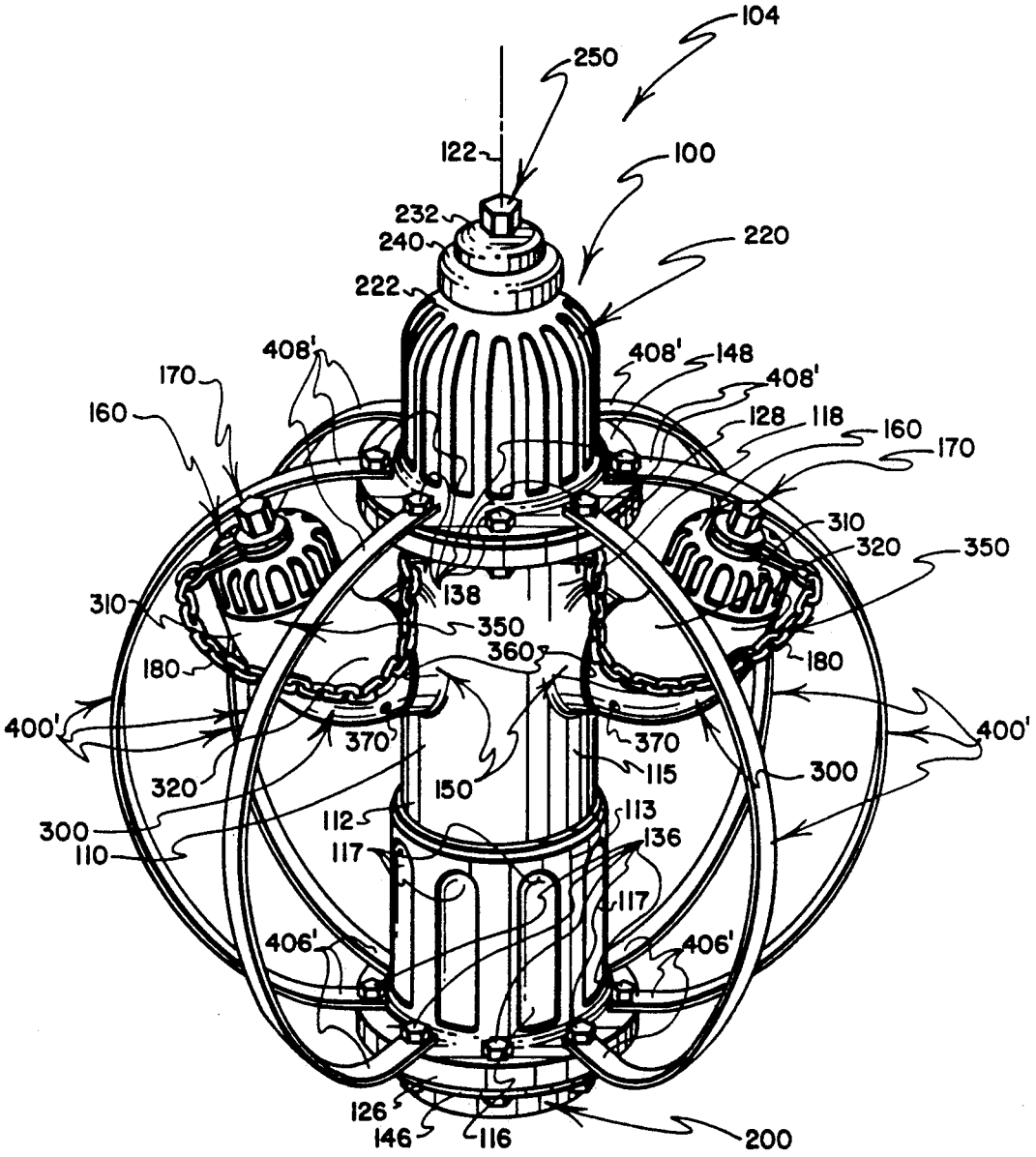
FIG. 4 is a perspective view of a fourth form of fire hydrant that incorporates selected features of the present invention including a pair of upwardly facing hose connections of the type that are utilized by the hydrant of FIG. 1, and an open-walled, cage-like protective enclosure of the general type that is utilized by the hydrant of FIG. 2.
Figure 5:
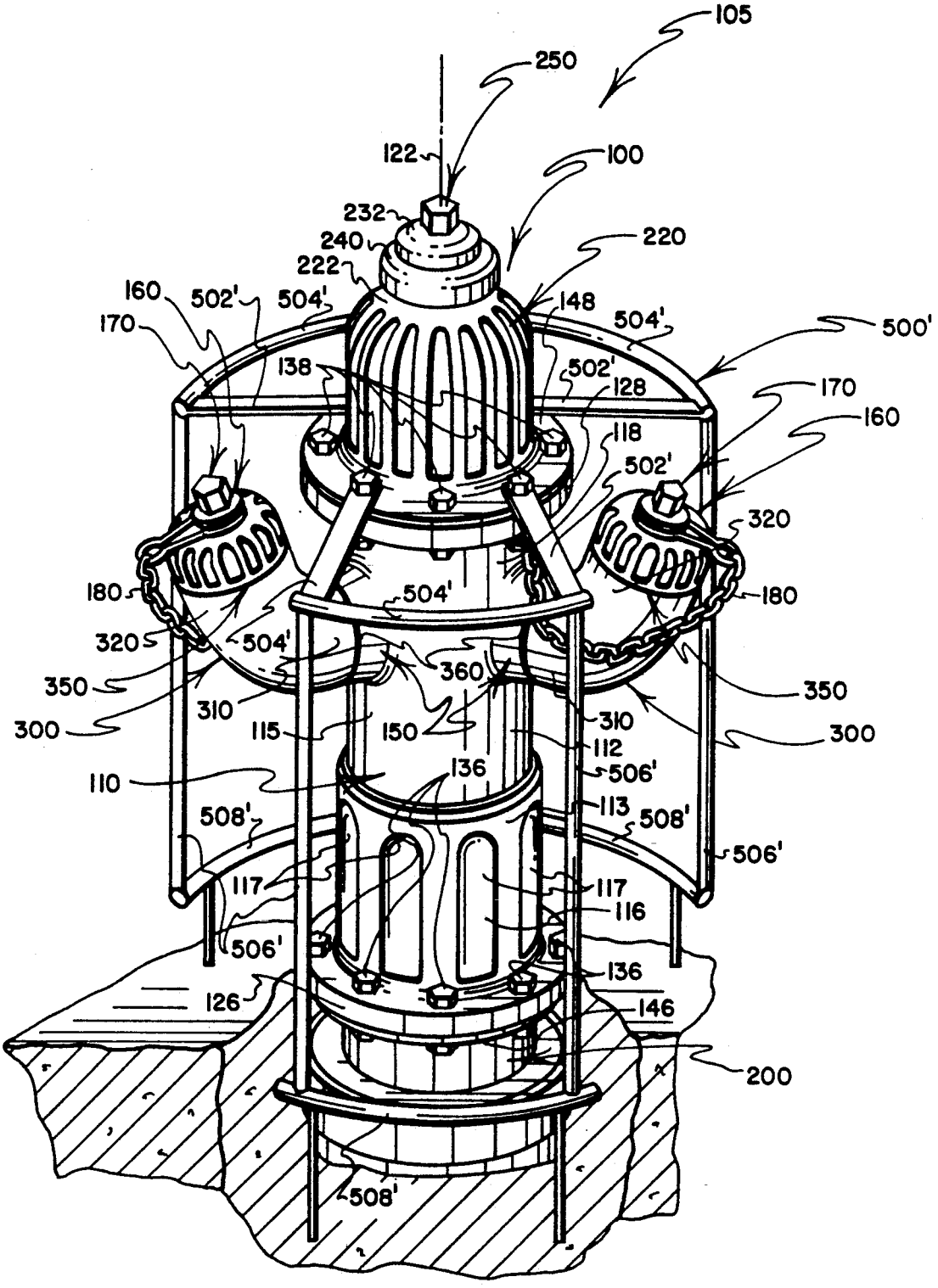
FIG. 5 is a perspective view of a fifth form of fire hydrant that incorporates selected features of the present invention including a pair of upwardly facing hose connections of the type that are utilized by the hydrant of FIG. 1, and an open-walled, cage-like protective enclosure of the general type that is utilized by the hydrant of FIG. 3, with portions of ground that normally surrounds the hydrant's supply pipe being removed.
Figure 6:
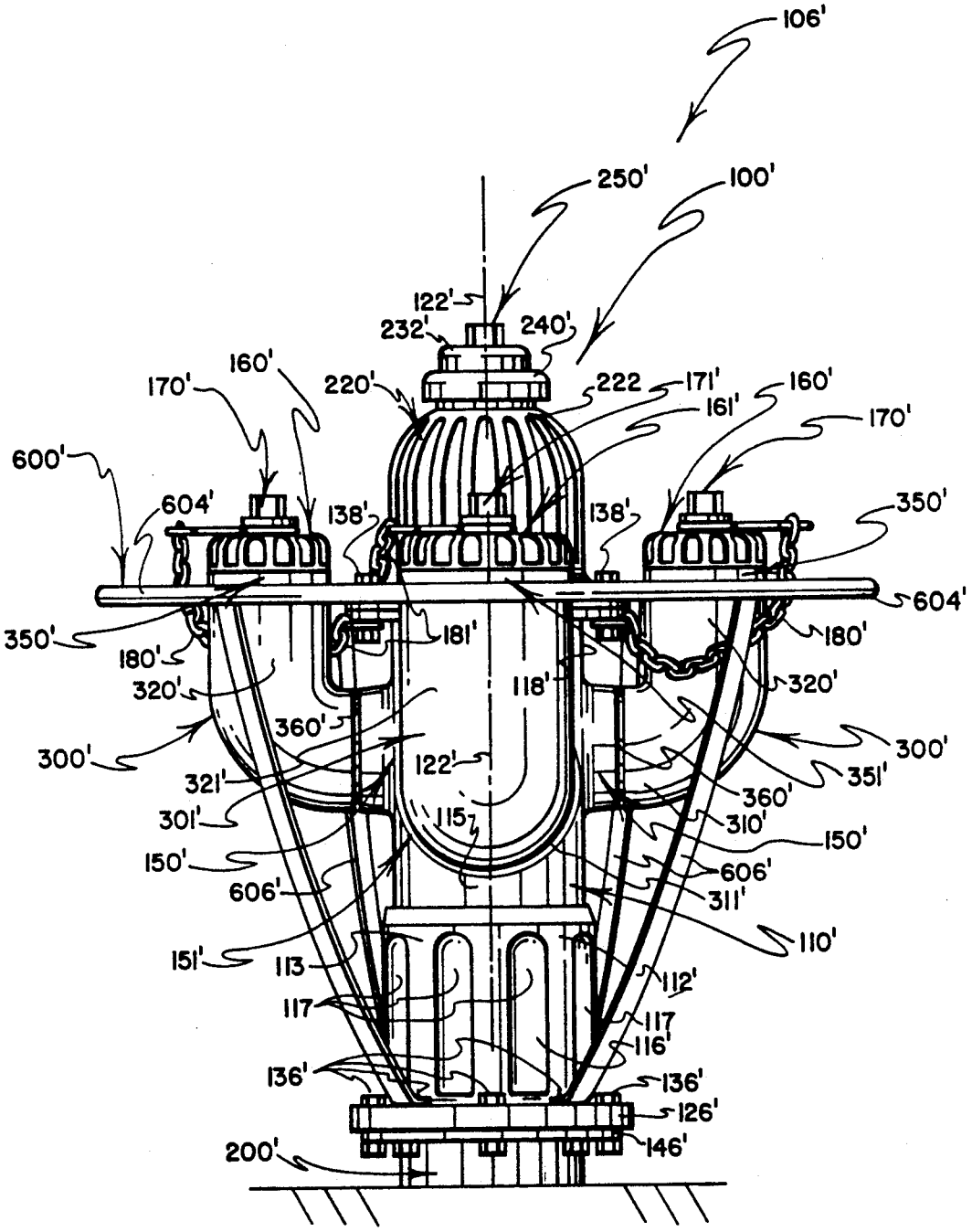
FIG. 6 is a front elevational view of a sixth form of fire hydrant that incorporates selected features of the present invention including a trio of upwardly facing hose connections and still another form of open-walled, cage-like protective enclosure.
Figure 7:
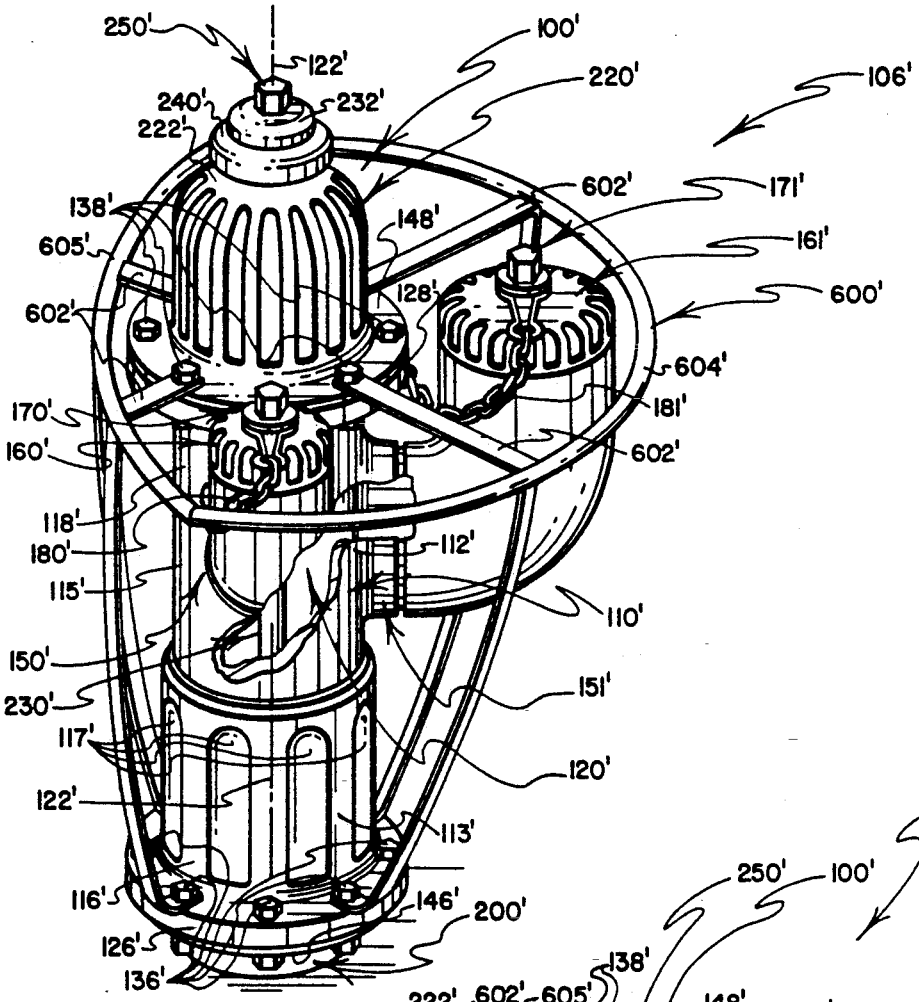
FIG. 7 is a perspective view of the fire hydrant of FIG. 6, with portions of the hydrant broken away to permit features of internal structure to be seen; and, FIG. 8 is a top plan view of the fire hydrant of FIGS. 6 and 7.
Figure 8:
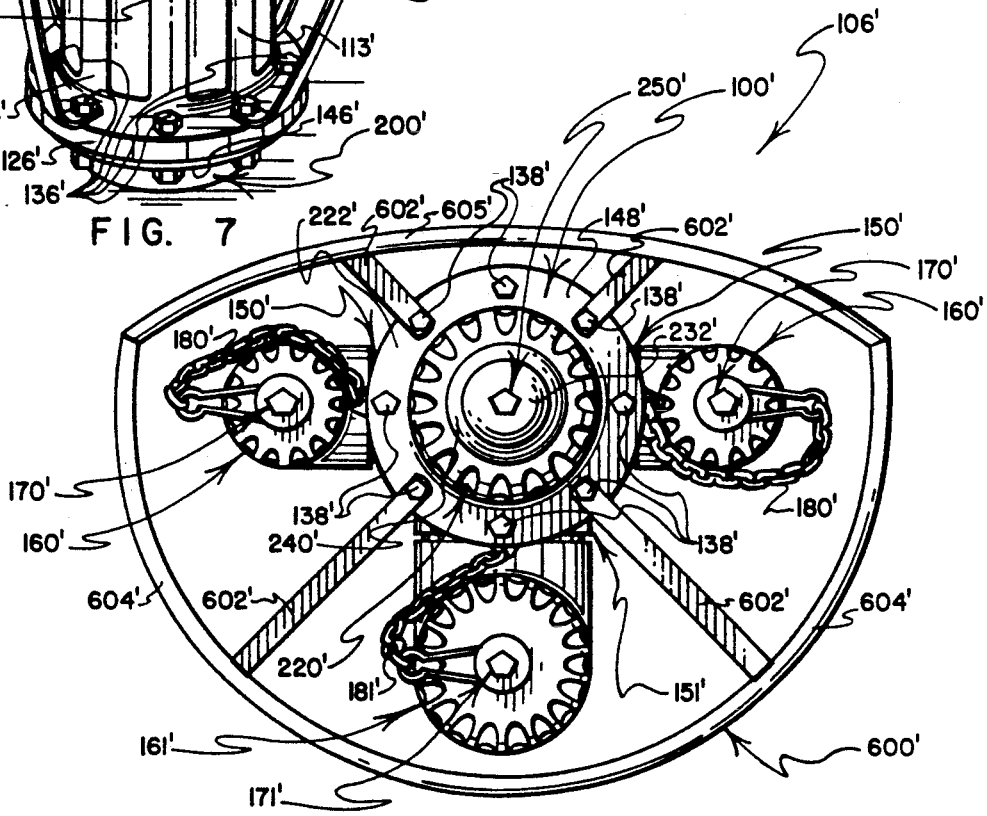

In the drawings, and in the description that follows, selected features of the present invention are illustrated and described as employed in conjunction with six fire hydrant embodiments, five of which are depicted in FIGS. 1–5, respectively, with the sixth being depicted in FIGS. 6–8. While features of the present invention can be put to use selectively with a wide variety of types, styles, configurations and forms of fire hydrants, it is believed that the six embodiments that are described and illustrated in this document appropriately illustrate how features of the present invention can be used separately or selectively in combination, whereby those who are skilled in the art will understand that the practice of the present invention can take a variety of forms.

If "most preferred embodiments" must be pointed to as representing the best mode known to the inventor for carrying out the practice of the present invention, the chosen embodiments would be the three that are depicted in FIGS. 4, 5 and 6–8, for these three embodiments make use not only of upwardly oriented hose connections but also of open-walled cage-like protective enclosures. If a "single most preferred" embodiment must be designated, it would be the embodiment that is depicted in FIGS. 6–8, for it illustrates the use of upwardly facing hose connections of a plurality of sizes in combination with the use of a sturdy but simply configured, simply constructed form of open-walled, cage-like protective enclosure that extends about selected portions of the fire hydrant in a manner that cordons off a limited region extending about the hydrant that is to be kept substantially obstruction free in order to provide a desired amount of clearance about the hydrant, and in order to provide a desired amount of access space within the vicinities of the hydrant's hose connections.

In the description that follows, an effort is made to simplify the discussion by utilizing a system of "identical" and "corresponding" reference numerals that alleviates the need to repetitiously describe features that do not differ from view to view (i.e., features that are "identical"), or that are of substantially the same general shape and serve substantially the same function but are not absolutely identical in that they may differ in size or placement or the like (i.e., features that "correspond"). In the two paragraphs that follow, the use of "identical" and "corresponding" reference numerals in this document is discussed more fully so that the "convention" of reference numerals used in this document will be understood.

Referring to FIGS. 1–5, what is depicted in each of these five FIGURES are five forms of practice of the present invention, all of which utilize an identical form of existing fire hydrant that is designated generally by the numeral 100. The hydrant 100 has an upstanding body 110 that defines a pair of hose connections 150 that are of identical size. Because such features as the hydrant bodies 110 and the hose connections 150 that are defined thereby do not vary from view to view among FIGS. 1–5, these identical features are designated in the drawings hereof by reference numerals that are identical.

Referring to FIGS. 6–8, a sixth form of practice of the present invention is illustrated that utilizes an existing form of fire hydrant that is designated generally by the numeral 100'. The hydrant 100' has an upstanding body 110' that defines not only a pair of hose connections 150' that "correspond" to the hose connections 150 of the hydrant 100, but also a third hose connection 151' that finds no corresponding component on the fire hydrant 100. Because such features as the hydrant bodies 110, 110' "correspond" generally in shape and function but are not precisely identical in form, "corresponding" reference numerals that are identical except for the presence or absence of an associated "prime" mark are used in the drawings to designate features that "correspond."

Because the practice of the present invention that is described and illustrated herein calls for modifications to be made to the hydrants 100, 100' (in the form of adding attachments thereto, as will be described and illustrated in greater detail), and because the resulting modified hydrant assemblies differ one from another, the six modified hydrant assemblies that are depicted in FIGS. 1, 2, 3, 4, 5 and 6–8, are designated generally by the reference numerals 101, 102, 103, 104, 105 and 106', respectively.

Turning now to a description of features of the conventional fire hydrants 100, 100' that are depicted in FIGS. 1–5 and 6–8, respectively, the hydrants 100, 100' have generally cylindrical, upstanding bodies 110, 110'. The bodies 110, 110' are hollow in the sense that they have relatively thick outer walls 112, 112' that extend from lower end region 116, 116' to upper end regions 118, 118' so as to define relatively large diameter central passages 120, 120' (see FIGS. 1 and 7) that extend substantially concentrically about substantially vertical imaginary center axes 122, 122', respectively.

Figure 1:
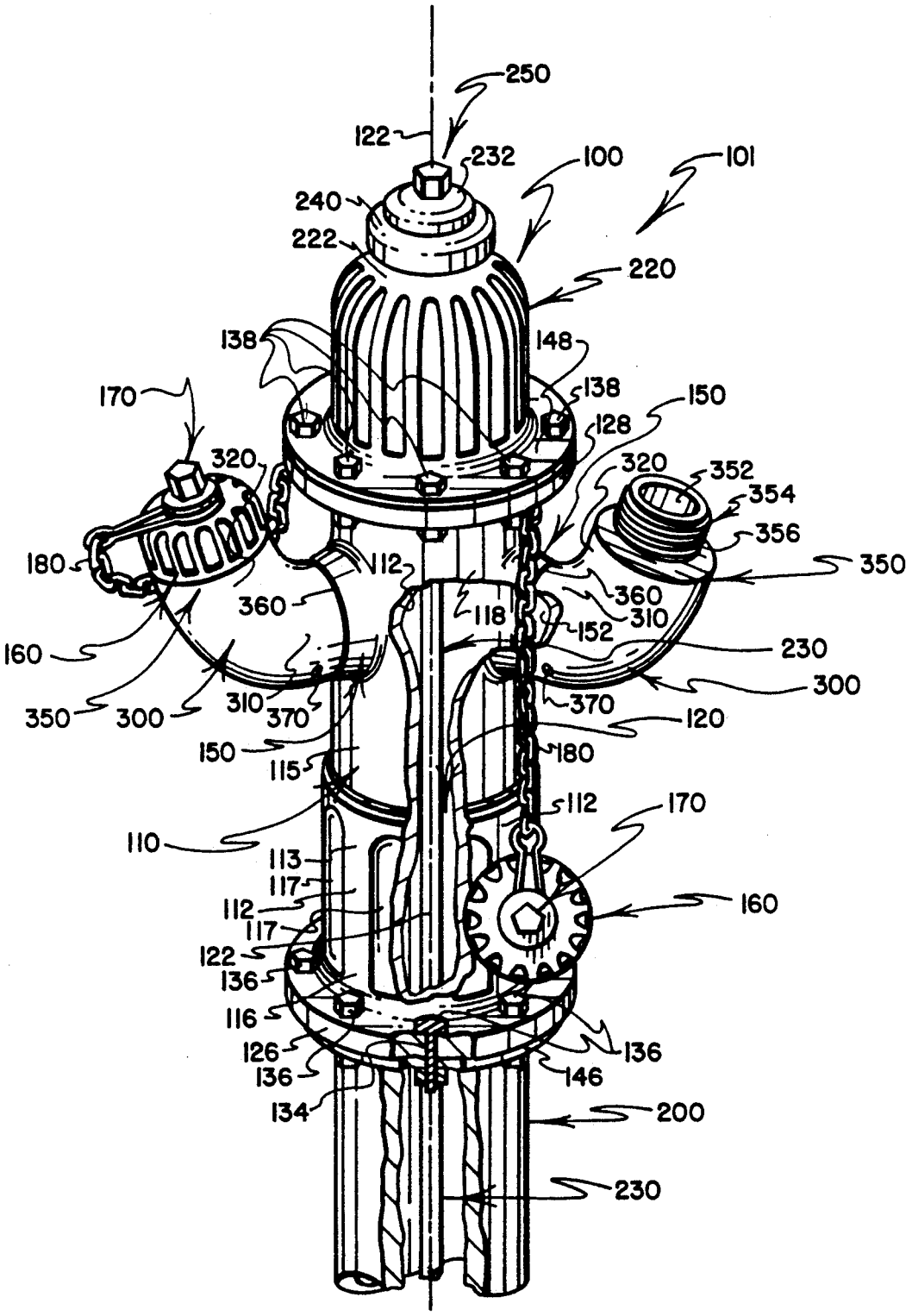
FIG. 1 is a perspective view of a first form of fire hydrant that incorporates selected features of the present invention including a pair of upwardly facing hose connections, with one of the hose connections having its normally installed cap removed, and with the view showing portions of the hydrant broken away to permit features of internal structure to be seen.

The hydrants 100, 100' have annular mounting flanges 126, 126' that extend circumferentially about the lower end regions 116, 116' of the bodies 110, 110', and annular mounting flanges 128, 128' that extend circumferentially about the upper end regions 118, 118' of the bodies 110, 110'. Bolt holes, one of which is depicted in FIG. 1 wherein it is indicated by the numeral 134, are provided through the flanges 126, 126', 128, 128' to receive lower arrays of bolts 136, 136' and upper arrays of bolts 138, 138' for securely connecting the lower flanges 126, 126' and the upper flanges 128, 128' to matingly configured flanges 146, 146' and 148, 148', respectively.

The flanges 126, 146 and the flanges 126', 146' are configured to extend closely in juxtaposition one to another, and have aligned holes formed therethrough to receive the bolts 136, 136'. One set of these aligned holes is depicted in FIG. 1 wherein it is indicated by the numeral 144. The flanges 126, 146 and the flanges 126', 146' matingly engage, when clamped together by means of tightening the bolts 136, 136' in place, and to cooperate with suitable gasketing or sealant material (not shown) to establish a secure, fluid-tight connection between the matingly engaging flanges 126, 146 and 126', 146', respectively.

In substantially the same manner, the flanges 128, 148 and 128', 148' are configured to extend closely in juxtaposition one to another, and have aligned holes formed therethrough (not shown) to receive the bolts 138, 138'. The flanges 128, 148 and 128', 148' matingly engage, when clamped together by means of tightening the bolts 138, 138' in place, and cooperate with suitable gasketing or sealant material (not shown) to establish a secure, fluid-tight connection between the matingly engaging flanges 128, 148 and 128', 148', respectively.

The hydrant bodies 110, 110' preferably are formed as one-piece metal castings, the relatively thick side walls 112, 112' of which extend between and interconnect the lower and upper mounting flanges 126, 128 and 126', 128'. While the side walls 112, 112' have outer diameter portions that differ in diameter along their lengths (e.g., see the lower parts 113, 113' of the side walls 112, 112' that are larger in diameter than are the upper parts 115, 115' of the side walls 112, 112'), and often are provided with decorative, ornamental features (e.g., see the flutes 117, 117' that are formed in the lower parts 113, 113' of the side walls 112, 112'), the side walls 112, 112' are, in essence, of generally cylindrical configuration—except where the aforementioned hose connections 150 and 150' 151' project outwardly from the side walls 112, 112' in substantially horizontal directions that extend substantially radially from the associated center axes 122, 122' of the hydrant bodies 110, 110'.

Figure 3:
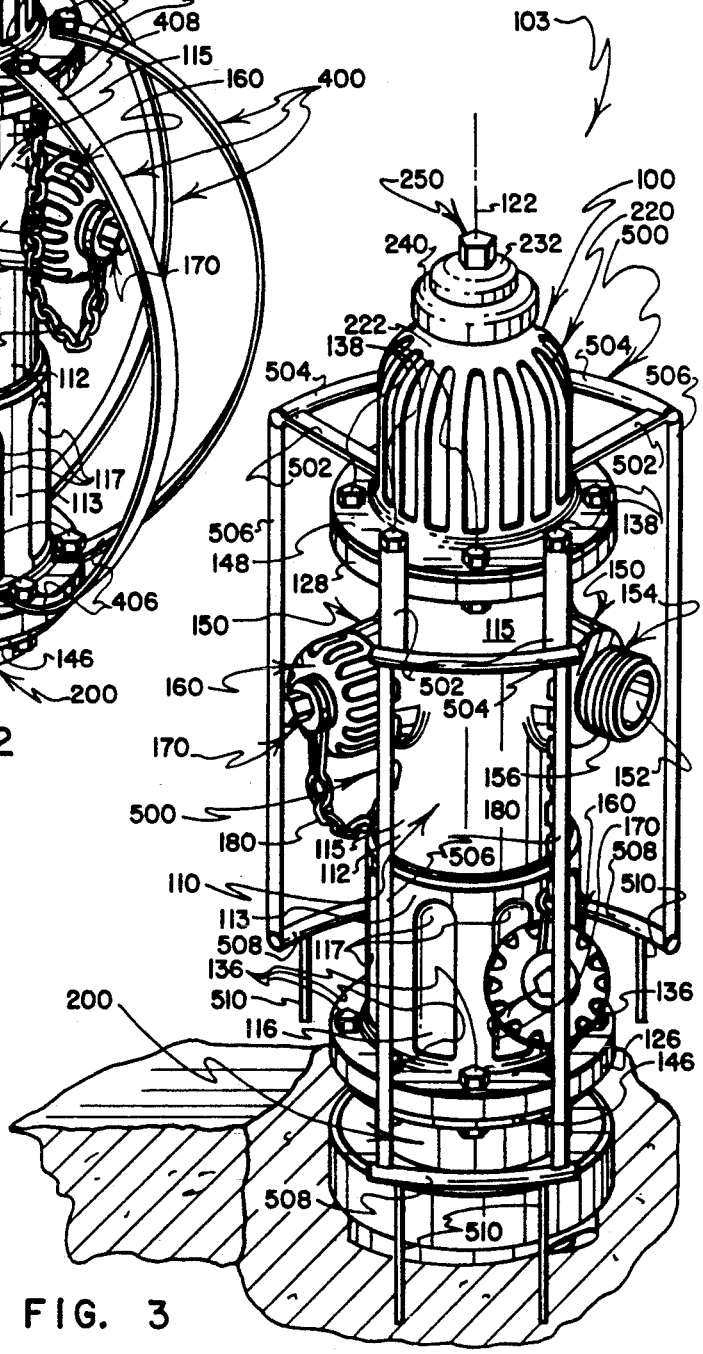
FIG. 3 is a perspective view of a third form of fire hydrant that incorporates selected features of the present invention including a second form of open-walled, cage-like protective enclosure, with one of the hose connections having its normally installed cap removed, and with portions of ground that normally surrounds the hydrant's supply pipe being removed.

The hose connections 150 and 150', 151' are hollow in that they define centrally extending through passages that communicate with the relatively large diameter central passages 120, 120' that extend upwardly through the hollow bodies 110, 110'. In FIG. 3, a typical one of the passages that extends through one of the hose connections 150 is indicated by the numeral 152. Outer end portions of the passages that extend through the hose connections 150 and 150', 151' are defined by threaded pipe-like end formations, a typical one of which is indicated in FIG. 3 by the numeral 154. Inasmuch as the hose connection 151' of the hydrant 100' has larger internal and external diameters than do the hose connections 150, 150', the threaded pipe-like end formation (not shown) that is defined by the hose connection 151' has larger internal and external diameters than are designated by the numerals 152, 154 in FIG. 3.

Such threads as are provided on the outer surfaces of the pipe-like end formations that are defined by the hose connections 150 and 150', 151' (typically in the manner that threads 156 are provided on the pipe-like formation 154 that is depicted in FIG. 3) are selected to meet such "standards" as facilitate the establishment of direct, threaded connections with conventional threaded connectors (not shown) that are provided at ends of commercially available fire hoses, preferably without the need to make use of one or more "adapters" or other forms of "fittings" or the like (not shown) to aid in quickly establishing tight, leak resistant connections between threaded hydrant connections 150, 150', 151' and conventional fire hose end connectors (not shown).

Figure 2:
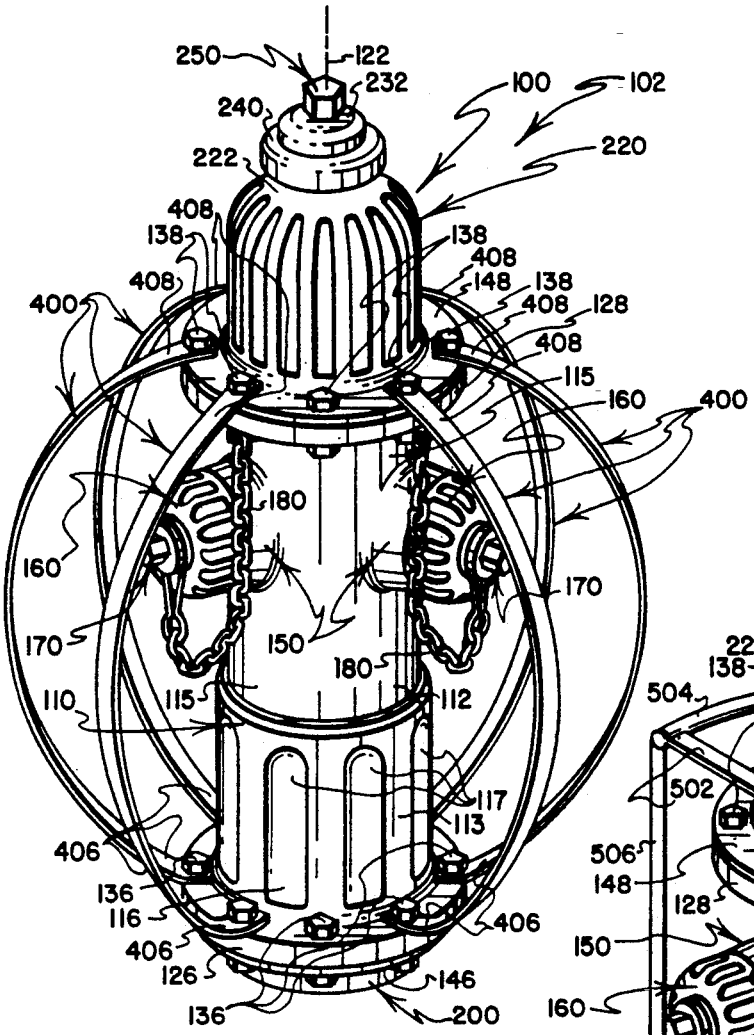
FIG. 2 is a perspective view of a second form of fire hydrant that incorporates selected features of the present invention including a first form of open-walled, cage-like protective enclosure.

To prevent entry through such passages as are defined by the hose connectors 150, 150', 151' (e.g., the passage 152 that is shown in FIG. 3), of unwanted debris, rainwater, insects, small animals and the like, and to prevent the unauthorized attachment of hoses and the like to the hydrant hose connections 150, 150', 151', internally threaded caps 160, 160', 161' are provided to be threaded onto the externally threaded hydrant hose connections 150, 150', 151'. In FIG. 2, both of the caps 160 are shown threaded onto their associated hose connectors 150. In FIG. 3, only one of the caps 160 is shown threaded onto its associated hose connector 150.

The caps 160, 160', 161' have five-sided tool-receiving head formations 170, 170', 171 that are configured to be engaged by a specially configured wrench (not shown) that is commonly carried by firefighters for use in accessing and operating fire hydrants. The head formations 170, 170', 171 are used to tighten the caps 160, 160', 161' in place on their respective hydrant assemblies 101, 102, 103, 104, 105, 106', and to effect removal of the caps 160, 160', 161' from their respective hydrant assemblies 101, 102, 103, 104, 105, 106'. To prevent the caps 160, 160', 161' from being lost, chains 180, 180', 181' are provided that each have one of their ends connected to an associated one of the caps 160, 160', 161' at locations near the associated head formation 170, 170', 171'. The other ends of the chains 180, 180', 181' are connected to selected ones of the bolts 138, 138'.

At the lower end regions 116, 116' of the upstanding bodies 110, 110' the bolts 136, 136' connect the lower mounting flanges 126, 126' with the mating flanges 146, 146' of hydrant supply pipes 200, 200'. The hydrant supply pipes 200, 200' depend from their connections with the hydrant bodies 110, 110' to underground locations (typically directly beneath the hydrants 100, 100') where conventional, commercially purchased, rotary-stem-operated hydrant supply valves (not shown) are provided for selectively communicating the hydrant supply pipes 200, 200' with an adjacent water main (not shown).

At the upper end regions 118, 118' of the upstanding bodies 110, 110' the bolts 138, 138' connect the upper mounting flanges 128, 128' with the mating flanges 148, 148' of crown-shaped caps 220, 220'. Centrally located openings (not shown) are formed through upper, centrally located portions 222, 222' of the crown-shaped caps 220, 220' through which upper end regions 232, 232' of relatively lengthy "valve stems" or "operating rods" 230, 230' extend (see FIGS. 1 and 7). Suitable seal assemblies 240, 240' are interposed between the crown-shaped caps 220, 220' and the upper end regions 232, 232' of the valve stems 230, 230' to prevent leakage therebetween while, at the same time, permitting the valve stems 230, 230' to be rotated relative to their associated crown-shaped caps 220, 220'. Tool-receiving, five-sided head formations 250, 250' (that preferably are identical in all respects to the five-sided head formations 170, 170' that are provided on the hose connection caps 160, 160') are defined by the upper end regions 232, 232' of the valve stems 230, 230'. The reason for using five-sided head formations 170, 170' and 250, 250' on the hose connection caps 160, 160' and the valve stems 230, 230' is that five-sided heads cannot easily be grasped and turned by conventional wrenches, but rather are intended to be engaged by the special wrenches that are carried by fire-fighters for accessing and operating fire hydrants.

The valve stems 230, 230' depend from within the interiors of the crown-shaped caps 220, 220', extend substantially along the imaginary central axes 122, 122' of the hydrant bodies 110, 110', and depend into the hydrant supply pipes 200, 200' for operating the aforedescribed conventional, commercially purchased, rotary-stem-operated hydrant supply valves (not shown) that typically are located in the ground beneath the hydrants 100, 100', which valves are operated by turning the valve stems 230, 230' to selectively communicate the hydrant supply pipes 200, 200' with an adjacent water main (not shown). When the valve stems 230, 230' are rotated about the central axis 122, 122' of the bodies 110, 110' in one direction of rotation, the aforedescribed underground-located valves open to communicate the hydrant supply pipes 200, 200' with an adjacent water main so that pressurized water is admitted to the supply pipes 200, 200' and into the hollow bodies 110, 110' of the hydrants 100, 100'. When the valve stems 230, 230' are rotated in the opposite direction, the below-ground hydrant supply valves close to terminate such communication and close off the supply of pressurized water to the hydrants 100, 100'.

When fire hydrants of the aforedescribed curbside styles 100, 100' are standing dormant but are otherwise ready to be used, the hydrant supply valves normally are closed, the hollow interiors 120, 120' of the hydrant bodies 110, 110' normally are not filled with pressurized water, and the caps 220, 220' normally are put in place to close hose connections to keep insects, rainwater, debris and other undesirable substances from entering the hollow interiors 120, 120' of the bodies 110, 110' of the hydrants 100, 100'.

The features described above are common to a wide variety of commercially available curbside style fire hydrants that are found installed along city streets, in municipal parking lots often also in municipal parking garages. The improvements that are made to such hydrants in accordance with one form of practice of the present invention involves providing and utilizing selected sets of attachments that are designed to minimize, if not eliminate, the need for "no parking zones" to be provided adjacent the installation of not only conventional curbside style fire hydrants but also with other forms of fire hydrants that are commercially available, including standpipe hose connection ports and the like that sometimes are installed in multi-level parking garages.

Referring to FIG. 1, an improvement that is made by way of added attachments to the hydrant 100 is to provide a pair of rounded elbows 300 that are threaded onto the conventional hose connections 150 of the hydrant 100 to provide upwardly oriented (i.e., upwardly directed, upwardly facing) hose connections 350 onto which the caps 160 can be threaded when the hydrant assembly 101 is not in use. The rounded elbows 300 have internal passages (one of which is indicated in FIG. 1 by the numeral 352) that communicate with the conventional hose connector passages (one of which is indicated in FIGS. 1 and 3 by the numeral 152).

Lower end portions 310 of the curved elbows 300 are internally threaded so as to matingly thread directly onto the threaded end regions of the conventional hose connectors 150 (one such threaded end region being indicated by the numeral 154 in FIG. 3 wherein the numeral 156 indicates the external threads formed thereon). Upper end portions 320 of the curved elbows have threaded end regions (one of which is indicated by the numeral 354 in FIG. 1) that carries external threads (see the threads indicated by the numeral 356 in FIG. 1) that permit either an associated one of the caps 160 to be installed thereon, or an interiorly threaded end region of a fire hose (not shown) to be coupled thereto.

When the curved elbows 300 are threaded onto the conventional hose connectors 150 of the hydrant 100, seals 360 formed from a suitably compressible gasketing or other seal-forming material such as neoprene or the like preferably are interposed between the lower end portions 310 of the curved elbows 300 and the hose connectors 150. To hold the curved elbows 300 securely in place, one or a pair of threaded holes (two of which are designated generally by the numeral 370 in FIG. 1) preferably are provided so that conventional set screws (not shown) can be threaded into the holes 370 to be tightened against the threads 156.

Referring to FIGS. 4, 5 and 6–8, it will be seen that, in the hydrant assembly embodiments 104, 105 and 106', identical or corresponding elbows 300, 300', 301' are installed on the conventional hydrant hose connections 150, 150', 151' together with seals 360, 360', 361' to provide new, upwardly-oriented hose connections 350, 350', 351'. When not in use, the conventional hose connection caps 160, 160', 161' are threaded onto the hose connections 350, 350', 351' to prevent the entry into the hydrant assemblies 104, 105, 106' of insects, rainwater, debris or other unwanted substances. The curved elbow 301' is larger in size than are the curved elbows 300', just as the hose connections 151', 351' are larger in diameter than are the hose connections 150', 350'. Lower and upper end portions of the curved elbow 351' are indicated by the numerals 311', 321', respectively.

In preferred practice, the elbows 300, 300', 301 are of smoothly curved configuration so as to provide an elbow shape that facilitates the flow of water therethrough with substantially no drop in pressure, and with a minimum of turbulence resulting as water flows through the elbows 300, 300', 301'. In preferred practice, the angle through which the elbows 300, 300', 301' curve is selected to assist in optimally directing the hose connections 350, 350', 351' that result when the elbows 300, 300', 301' are duly installed on the hose connections 150, 150', 151' of the hydrants 100, 100' so that motor vehicles can be parked adjacent the hydrants 100, 100' without intruding into access space surrounding the hose connections 350, 350', 351' that should be kept obstruction free so that fire hoses can be easily coupled to the hose connections 350, 350', 351'. The angle through which the elbows 300, 300', 301' curve preferably is within the range of about 30 degrees to about 100 degrees, with a most preferred angle being within the range of about 75 degrees to about 90 degrees While the curved elbow attachments 300, 300', 301' preferably are formed from metal such as steel, cast iron or other suitably strong and rigid metals, or from plastic or composite materials that are suitably rigid, strong and capable of withstanding sunlight and the extremes of temperature and force that components of fire hydrants must be able to withstand without malfunction.

An advantage that results from providing a fire hydrant with one or more of the curved elbow attachments 300, 300', 301' is to provide a capability to optimally reorient one or more hydrant hose connections so that such clearance as needs go be maintained about the hydrant can be held to a minimum. In many instances, the best way to minimize needed clearance is to use curved elbow attachments with each of the hydrant's hose connections to reorient all of the hydrant's hose connections to face them in an upwardly-oriented attitude. This simple change from the conventional horizontally-extending orientation of fire hydrant hose connections will, in many instances, be sufficient to so diminish needed clearance and access space as to safely permit the elimination of "no parking zones" adjacent fire hydrants.

Referring to FIG. 2, another form of improvement is made by way of adding open-walled, cage-like enclosure components as attachments to the hydrant 100. In the hydrant assembly embodiment 102 of FIG. 2, a plurality of curved strap-like members 400 are attached to the hydrant 100. The strap-like members 400 have opposed lower and upper end regions 406, 408 connected to separate ones of the lower and upper bolts 136, and 138. Referring to FIG. 4, a similar improvement is made to the hydrant 100 by adding relatively more lengthy curved strap-like members 400' that arc sufficiently far away from their associated hydrant 100 as to assist in preserving obstruction free access space that extends about the hose connections 350. The curved, strap-like members 400' have opposed lower and upper end regions 406', 408' connected to separate ones of the lower and upper bolts 136, 138.

The curved strap-like members 400, 400' preferably are formed from metal such as steel or other suitably strong and resilient metals, plastics or composite materials that are suitably rigid, resilient, strong and capable of withstanding sunlight and the extremes of temperature and force that components of fire hydrants must be able to withstand without malfunction.

An advantage that results from providing a fire hydrant with the curved strap-like members 400, 400' is to provide a simple and inexpensive way to ensure that such clearance as needs go be maintained about a fire hydrant is maintained so that, even if a vehicle is parked nearby, adequate obstruction free access space will be maintained to permit hose connections to be used as needed, and to permit the hydrants to be used to fullest possible advantage, as needed. This simple addition to existing fire hydrants will, in many instances, be sufficient to so ensure needed clearance and access space as to safely permit the elimination of "no parking zones" adjacent fire hydrants.

Referring to FIG. 3, an improvement that is made by way of added attachments to the hydrant 100 is to provide open-walled cage-like structures or components thereof that cooperate to ensure that good and sufficient clearance is maintained about the hydrant assembly 103, and that needed access space is maintained to permit fire hoses to be coupled with ease to the hose connections of the hydrant assembly 103. The structures 500 are formed from components that include: components 502 that extend substantially radially inwardly and outwardly about the upper end region 118 of the hydrant 100 and have inner end regions that are connected to selected ones of the upper bolts 138 of the hydrant 100; upper arcuately extending components 504 that are rigidly connected to and are supported by the inwardly extending components 502; upstanding components 506 that depend from the arcuate components 504 to positions where they are engaged by lower arcuately extending components 508; and ground penetrating rods 510 that depend from the lower arcuate components 508 to anchor the cage-like structures 500 in place about the fire hydrant 100.

Referring to FIG. 5, an improvement similar to that disclosed in FIG. 3 is made to the hydrant 100 by adding cage-like structures 500' (or cage-like structural segments) that have relatively more lengthy inwardly extending components 502'; relatively more lengthy upper arcuately extending components 504'; identical upstanding components 506; relatively more lengthy lower arcuate components 508'; and that have identical ground penetrating rods 510 for anchoring the cage-like structures 500' in place about the fire hydrant 100'. The more lengthy components 502', 504', 508' permit the cage-like structures 500' to extend sufficiently far away from their associated hydrant 100 as to assist in preserving obstruction free access space that extends about the hose connections 350.

The components that form the structures 500, 500' preferably are formed from metal such as steel or other suitably strong and resilient metals, plastics or composite materials that are suitably rigid, resilient, strong and capable of withstanding sunlight and the extremes of temperature and force that components of fire hydrants must be able to withstand without malfunction.

An advantage that results from providing a fire hydrant with the structures 500, 500' is to provide a simple and inexpensive way to ensure that such clearance as needs go be maintained about a fire hydrant is maintained so that, even if a vehicle is parked nearby, adequate obstruction free access space will be maintained to permit hose connections to be used as needed, and to permit the hydrants to be used to fullest possible advantage, as needed. The simple addition to existing fire hydrants will, in many instances, be sufficient to so ensure needed clearance and access space as to safely permit the elimination of "no parking zones" adjacent fire hydrants.

Referring to FIGS. 6–8, a modified form of protective cage structure 600' is provided that is configured to extend about the curved elbows 300', 301' and about the hose connections 350', 351' that are defined thereby to maintain appropriate hydrant clearance and to provide obstruction-free access to for connecting fire hoses (not shown) to the hose connections 350', 351'. The structure 600' includes inwardly extending components 602' that are connected to selected ones of the upper bolts 138' of the hydrant 100'; upper arcuately extending 604', 605' that are rigidly connected to and are supported by the inwardly extending components 602'; upstanding components 606' that depend from the arcuate components 604', 605' to positions where they are connected to selected ones of the lower bolts 136'.

An advantage that results from providing a fire hydrant with an open-walled, cage-like protective structure such as the structure 600' is to provide a simple and inexpensive way to ensure that such clearance as needs to be maintained about a fire hydrant is maintained so that, even if a vehicle is parked nearby, adequate obstruction free access space will be maintained to permit hose connections to be used as needed, and to permit the hydrants to be used to fullest possible advantage, as needed. Because the size and shape of the space that is enclosed by the arcuate components 604', 605' can be selected to correspond quite closely to precisely provide suitable clearance and access space extending about the hydrant 100', this simple addition to existing fire hydrants will, in many instances, be sufficient to so ensure needed clearance and access space as to safely permit the elimination of "no parking zones" adjacent fire hydrants.

Still another advantage that can result from providing a fire hydrant with an open-walled, cage-like protective enclosure such as the structure 600' is that, if pedestrians happen to inadvertently bump into a cage-protected hydrant, there is less of a likelihood for injury to significant injury to result, for an open-walled, cage-like protective enclosure tends to extend about and shroud major parts of the outwardly projecting portions of the rigid hose connections. This advantage can be quite meaningful to those who have poor night vision and to blind persons who may inadvertently come into contact with a fire hydrant and who might encur injury were it not for the presence of a protective cage-like enclosure.

While the cage structure 600' preferably is formed as a welded assemblage of steel members that are configured and positioned to form the various described component parts, other suitably strong and resilient metals, plastics or composite materials that are suitably rigid, resilient, strong and capable of withstanding sunlight and the extremes of temperature and force that components of fire hydrants must be able to withstand without malfunction.

In forming the open-walled, cage-like protective structures 500, 500', 600', the spoke-like components 502, 502', 602' that extend from upper end regions 118, 118' of the hydrants 100, 100' should be long enough to position the outer arcuate components 504, 504,, 604', 605' outside the extension radius of the hose outlets 150, 150', 151', 350, 350', 351, 351' and short enough to allow a vehicle to park as close to the associated hydrant as safety will allow. While the outer ring components 502, 502', 602' are depicted in the drawings as being generally arcuate in shape, it will be understood that many other shapes and component parts thereof may be utilized including shapes that are elliptical, parabolic, square, rectangular, pentagonal, hexagonal or any combination thereof.

By combining the use of curved elbows to optimally reorient hose connections, and the use of open-walled cage-like protective enclosures, for example as is illustrated by the hydrant assemblies 103, 104, 105, 106' in FIGS. 3, 4, 5 and 6–8, the advantages of both of these approaches combine to ensure that adequate clearance and access space is provided while, in most instances, permitting "no parking zones" adjacent a fire hydrant to be safely eliminated without detrimentally affecting the use that can be made of the hydrant.

As will be apparent from the foregoing discussion of features of the invention taken together with the claims that follow, the present invention serves to prevent vehicles from parking in locations that will interfere with the use of fire hydrants, while, at the same time, permitting vehicles to park much more closely to fire hydrants than is permitted when a pair of parking spaces are sacrificed to provide quite a sizable open space adjacent a fire hydrant, which is the approach that is widely used at present. By utilizing features of the present invention, at least two parking spaces per fire hydrant ordinarily can be reclaimed, thereby adding quite significantly to the availability of premium vehicle parking space in downtown areas of cities—and, at the same time, adding quite significantly to the revenue that is received daily from city rentals of on-street and off-street parking space. Because the revenue generated by parking space rentals tends to be within the range of millions of dollars per year for sizable cities, increasing such revenue by a factor of ten to twenty percent can do a great deal to provide such additional funds as typically are needed to premit additional police, fire, rescue and other safety forces personnel to be hired, whereby the boonddoggle "safety" provision of "no parking zones" adjacent fire hydrants can be converted into safety related benefits that unquestionably will save lives and property.

While the foregoing discussion has been presented in terms of working with existing fire hydrants, as those who are skilled in the art readily will understand, features of the present invention can just as easily be used with newly manufactured fire hydrants, with repaired or remanufactured fire hydrants, and with any fire hydrant that is being installed as well those that are being serviced or replaced.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A system for enhancing utilization of parking space adjacent a fire hydrant wherein the fire hydrant has an upright tubular body and a laterally directed port along said body communicating at one end with the interior of the hydrant body and terminating at its other exterior end in coupling means for connection to a hose, comprising:

attachment means defining a tubular pipe elbow, said elbow at one end thereof having coupling means for detachably securing the said elbow to said hydrant hose coupling means, and said elbow at the other end thereof having coupling means corresponding to those of said hydrant hose coupling means and such that said elbow may be coupled to the hydrant with said elbow other end directed upwardly at an angle, said attachment means further including means defining a protective cage extending about said hydrant and said pipe elbow, said cage extending outwardly from said hydrant beyond said elbow, and, means for connecting said protective cage to the hydrant, thereby to define a predetermined clearance space about said hydrant and said elbow pipe free from intrusion by large, objects, as automobiles, disposed proximate to said hydrant, and thus to facilitate access to said upwardly directed pipe other end in connecting a hose thereto irrespective of the proximity of such large objects.

2. The system of claim 1 wherein said angle is within the range of about 30 degrees to about 100 degrees.

3. The system of claim 1 wherein said angle is within the range of about 75 degrees to about 90 degrees.

4. The system of claim 1 wherein the protective cage includes at least one elongate outer component for extending about at least a part of the periphery of said clearance space.

5. The system of claim 4 wherein the projective cage additionally includes a plurality of elongate spoke components that each have an outer end region that is connected to the elongate outer component, and an inner end region that is configured to be connected to the selected hydrant for positioning the elongate outer component to extend about said part of said clearance space.

6. The attachment of claim 5 wherein the protective cage component additionally includes at least one elongate upwardly extending support component that has one end region thereof connected to at least one of the other components of the cage member that is selected from among the spoke components and the outer component, and that has an opposite end region thereof that is configured to be connected to a lower portion of the fire hydrant.

7. The attachment of claim 5 wherein the protective cage additionally includes at least one elongate upwardly extending support component that has one end region thereof connected to at least one of the other components of the cage member that is selected from among the spoke components and the outer component, and that has an opposite end region thereof that extends into ground contact about the fire hydrant.

8. The system of claim 1 wherein said hydrant port coupling means is a threaded connection, and said elbow one end coupling means is of a predetermined complementary threaded configuration such that when said elbow one end is fully threaded to said hydrant port, said elbow other end is directed upwardly.

9. The system of claim 1 further including lock means carried by said elbow for releasably securing said elbow to said hydrant with said elbow other end directed upwardly.

10. The system of claim 1 wherein said lock means comprises a set screw cooperatively associated with said elbow one end coupling means.

11. Attachments for a fire hydrant to reorient the hose connections of the hydrant and to ensure that good and sufficient clearance and hose connection access space is maintained about the hydrant so that at least one motor vehicle can park adjacent the hydrant without diminishing the ease with which fire hoses can be connected to the hose connections of the hydrant, comprising:

a) a separate hollow curved elbow for attachment to each of the hose connections of a fire hydrant, wherein each of the elbows has first and second opposed end regions located at opposite ends of a hollow curved passage that extends through the elbow, with the first end region being configured to be directly connected to its associated hydrant hose connection both to support the hollow curved elbow on the hydrant and to communicate the hollow curved passage of the hollow curved elbow with a water supply opening that is defined by the associated hydrant hose connection, with the second end region being configured to define an upwardly oriented hose connection to which a fire hose can be directly connected in a manner that communicates the hollow curved passage of the hollow curved elbow with the interior of said hose; and, b) protective cage means including structure for being attached to the fire hydrant to extend outwardly from said hydrant beyond said elbows and to extend about the hose connections of the hydrant that are provided by the second end regions of the elbows that are attached to the hydrant to assist in maintaining desired clearance space extending about selected portions of the hydrant that include the vicinities of the hose connections that are provided by the second end regions of the elbows so that motor vehicle parking can safely be permitted beside the hydrant.

12. In a free-standing ground-mounted fire hydrant having an upright tubular body extending upwardly from the ground, an upper closure therefor, a laterally directed port along said body communicating at one end with the interior of the hydrant body and terminating at its other exterior end in a coupling means for connection to a hose, and removable cap means for said port coupling connection for normally closing said port when not connected to a hose, the improvement comprising, an elbow-shaped pipe member having at one end complementary coupling means for connecting to said hydrant port exterior end, and said pipe member having coupling means at its other end for connection to a said hose or to said cap means when not connected to a hose, said pipe member when connected to said hydrant having its said other end extending substantially in an upward direction, thereby to facilitate connection of a hose thereto from above the hydrant, and, means defining a protective cage connected to and extending about said hydrant and said elbow pipe member, said cage extending outwardly from said hydrant beyond said elbow pipe member, thereby to define a predetermined clearance space about said hydrant and said elbow pipe member free from intrusion by large objects, such as automobiles, and thus to facilitate access to said upwardly directed pipe member other end in connecting a hose thereto irrespective of the proximity of a large object as an automobile.

13. The improvement in said free-standing ground-mounted fire hydrant of claim 12 wherein said elbow-shaped pipe member at its said one end is provided with positive lock means for securing said pipe member to said hydrant port with said pipe member other end extending in the upward direction.

14. The improvement in said free-standing ground-mounted fire hydrant of claim 13 wherein said lock means comprises set screw means carried by said pipe member one end for cooperatively engaging said hydrant port exterior end coupling means.

15. The improvement in said free-standing ground-mounted fire hydrant of claim 12 wherein further said hydrant is ground-mounted adjacent a roadway curb parking area for automobiles, and wherein said protective cage means extends between the hydrant and the curb parking area to render said elbow pipe member free close intrusion theretoward by objects such as automobiles, thereby facilitating parking of automobiles at the curb in proximity to the hydrant to maximize parking space utility while ensuring ready unobstructed access to said upwardly directed pipe member other end to connect a hose thereto.

16. The improvement in said free-standing ground-mounted fire hydrant of claim 12 wherein said cage includes elongated outwardly extending barrier elements connected at an upper end to said hydrant at the top thereof above said port and at a lower end to said hydrant below said port.

17. The improvement in said free-standing ground-mounted fire hydrant of claim 12 further including a plurality of said ports on said hydrant, and a plurality of said elbow pipe members respectively connected thereto.

* * * * *